United States Patent [19]

Onodi et al.

[11] 4,215,487

[45] Aug. 5, 1980

[54] DRYING EQUIPMENT

[75] Inventors: Zoltán Ónodi; Sándor Mikola; Ferenc Farkas; István Kovács, all of Mezötur, Hungary

[73] Assignee: Szolnok Megyei Tegla- es Cserepipari Vallalat, Mezotur, Hungary

[21] Appl. No.: 946,518

[22] Filed: Sep. 28, 1978

[30] Foreign Application Priority Data

Oct. 6, 1977 [HU] Hungary ..... SO 1198

[51] Int. Cl.[2] ..... F26B 17/12

[52] U.S. Cl. ..... 34/167; 34/22; 34/225

[58] Field of Search ..... 34/22, 25, 166, 167, 34/168, 187, 225, 233; 432/96, 97

[56] References Cited

U.S. PATENT DOCUMENTS 2,660,809 12/1953 Morrison ..... 34/167

4,092,784 6/1978 Dietrich et al. ..... 34/168 X 4,120,644 10/1978 Numasaki et al. ..... 34/168 X

FOREIGN PATENT DOCUMENTS 1022524 1/1958 Fed. Rep. of Germany ..... 34/168

*Primary Examiner*—Edward G. Favors

*Attorney, Agent, or Firm*—Young & Thompson

[57] ABSTRACT

Subject of the invention is drying equipment suitable for reducing the moisture content of fragmentary materials, mainly clay. The drying equipment contains drying space developed as a ring of circular, or polygonal base, surrounded with latticed surfaces. The drying space includes a channel developed as a ring of circular, or polygonal base, surrounded with latticed surface, carrying drying medium. The device, feeding the material to be dried is connectible to and turnable around the central shaft. Conveyance of the material takes place with the aid of a rotary worm or scraper device fixed to the central shaft.

6 Claims, 1 Drawing Figure

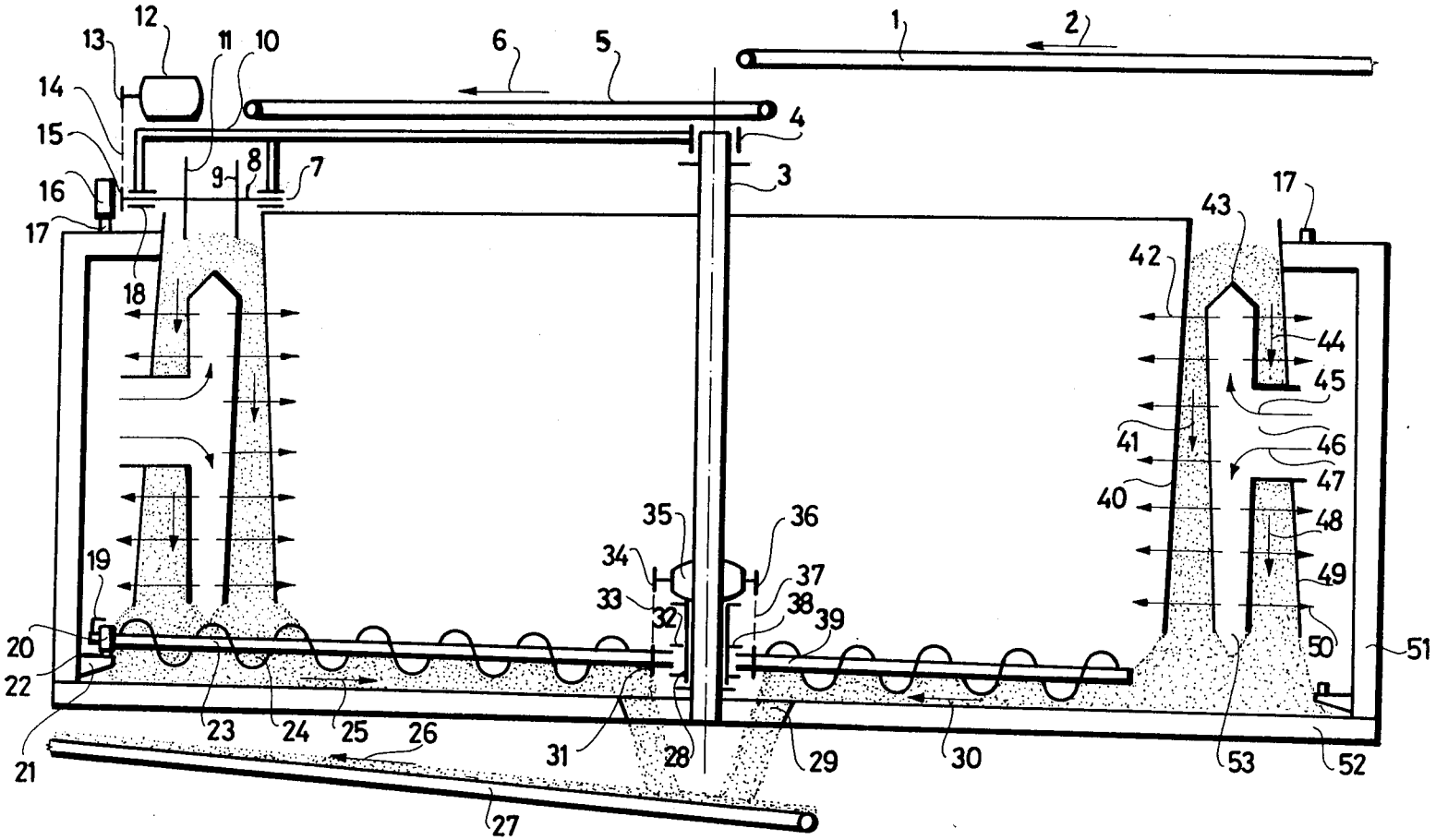
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53

DRYING EQUIPMENT

Subject of the invention is drying equipment suitable for reducing the moisture content of fragmentary materials, mainly clay.

Modernization of the products in the ceramic industry, especially in the field of the brick industry, requires that in the production of thin-walled wares no clay in excess of 20–22% moisture content should enter the production lines. However, moisture content of the clay extracted from quaries reaches 30–32%, thus the thin-walled product is generally producible only in inferior quality. One of the reasons is found in the deformation of the thin-walled product in its green condition, the other reason is that no adequate pressure can be ensured in the press, consequently the density of the product will not be sufficiently uniform.

It is well-known that the products made from clay of 30–32% moisture content are dried in an artificial drier. In the course of drying the extruded green product, the drying surface is considerably less, than in its fragmentary condition. The degree of efficiency of dewatering in the artificial drier is relatively low, since gererally 1100 kcal heat is necessary for the abstraction of 1 kg water.

In order to eliminate these drawbacks, the 30–32% moisture content of the clay extracted from the quarry should be reduced to 20–22%. To obtain efficient drying it is advisable to carry out the drying in a fragmentary condition, thus the drying surface is larger.

The object of the invention is to provide drying equipment suitable for drying fragmentary clay, for reducing its moisture content and making it usable in any technological production line.

This object is attained by providing drying equipment, that contains drying space developed as a ring of circular or polygonal base, surrounded with latticed surfaces, including a channel developed as a ring of circular or polygonal base, surrounded with latticed surfaces carrying drying medium in the drying space, as well as feeding devices and conveyors for the material to be dried. The feeding and conveyor devices are turnable around a central shaft.

The feeding device is preferably a conveyor belt connected to and turnable around the central shaft. The material to be dried is fed into the upper part of the annular drying space, where a rotating leveler is installed for spreading the material and to prevent its arching. The level determines the level of the material and thus controls thefeeding automatically, whereby the level of the material in the drying space is uniform and constant. In this way it is ensured that the channel of the drying medium is nowhere idle, and no loss of the drying medium should occur.

The material to be dried moves vertically down, surrounding the channel of the drying medium in the drying space, while the introduced drying medium—as a result of the internal pressure arising in the channel—flows through the latticed surfaces and the fragments between them, thus through the granular material reaching different sides of the material, in this way increasing the drying surface and thereby the intensity and efficiency of the drying process.

Space is provided between the base plate of the drying space and equipment for the worm or scraper device, one end of which is connected to the central shaft, while the other end is supported by a circular rail. This device preferably rotates both around its own shaft, and around the central shaft, thus carrying the material to the opening in the centre of the base plate. The material passes through the opening for instance onto a conveyor belt to be forwarded to the production lines. In case of need for higher capacity, several worms or scraper devices may be installed.

The advantage of the drying equipment according to the invention is its efficient operation: 700–800 kcal is necessary to abstract 1 kg water. It needs no separate heat source, those existing in the ceramic industry may be used. During the hot summer season it can be operated with the outside air without addtional heat demand. The difference between the 20–22% moisture content necessary for processing the clay and the 30–32% moisture content of the clay extracted from the quarry can be more efficiently abstracted, furthermore in this way the correct operation of the production lines and good quality of the product can be ensured.

In the following, the invention is described in detail. The drawing shows the sectional view of the drying equimpent according to the invention.

The drying equipment contains drying space developed as a ring of circular or polygonal base, surrounded with latticed surfaces 40 and 49, which includes a channel 53 developed as a ring of circular or polygonal base, surrounded by latticed surface 43. This channel 53 is provided with channels 46 for intoducing the drying medium, several of which may be arranged on the circumference. The lattices surfaces 40, 43 and 49 are held by vertical supports 51. The vertical supports 51 are fixed to the base plate 52. The drying space and channel 53 in it are arranged centrally around central shaft 3. A device feeding the material to be dried, preferably a conveyor belt 5 is connected at the top to the central shaft 3. The conveyor belt 5 is supported by swivel arm 10 through bearing 4. Bearing 4 ensures vertical support and rotary motion. The other end of the swivel arm 10 is supported by circular rail 17 through wheel 16. Wheel 16 is driven by motor 12 through chain wheels 13 and 15 with the aid of roller chain 14. Shaft 8 of wheel 16 rotates in bearings 7 and 18, ensuring the motion of swivel arm 10. Rotating leveler 11—spreading and preventing arching—is mounted on shaft 8. A gap is provided between the drying space and base plate 52, to accommodate shaft 23 with the mounted worm 24. One end of the shaft 23 is connected to central shaft 3 through bearing 28, with the aid of which it is turnable around central shaft 3. Shaft 23 is turnable around its own axis too, through bearing 32 connected with bearing 28. Wheel 20 is located on the other end of shaft 23, supported by circular rail 22 on cantilever 21. Wheel 20 is driven by shaft 23.

Operation of the drying equipment is the following:

The material to be dried passes in the direction of arrow 2, to the centre with the aid of conveyor belt 1, where it is taken over by conveyor belt 5 and forwarded in the direction of arrow 6. The material passes from the conveyor belt 5 into the space surrounded by latticed surfaces 40 and 49 and 43, filling up the space entirely and surrounding channel 53. The scattered material is spread by levelers 9 and 11, which besides preventing arching, controls the level of the material and controls the movement of conveyor belt 5, thus ensuring the constant level of the material. The drying medium flows in the direction of arrows 45 and 47, through inlet channel 46 into channel 53. Over-pressure arises in channel 53, as a result of which, the drying medium flows through the loose, fragmentary material in the direction of arrows 42 and 50, ensuring maximum drying surface. Worm 24 turning together with shaft 23, collects the material from under the drying space, carrying it in the direction of arrow 25 to opening 29. In case of higher output demand, several worms may be arranged, as shown in the drawing by worm 39 opposite worm 24. Worms 24 and 39 are driven by driving gear 35 through chain wheels 31, 34 and 36, 38 with the aid of chains 33 and 37. Worms 24 and 39 running along a circular track collect the material from under the drying space at a continuous rate, as a result of which the material in the drying space moves vertically down in the direction of arrows 41, 44 and 48. The material carried by worms 24 and 39, passes in the direction of arrows 25 and 30 onto the conveyor belt 27 through opening 29. Conveyor belt 27 carries the material in the direction of arrow 26 to the required place.

The size of the drying space is determined by the quantity of material to be dried per hour, and by quantity of the water to be evaporated. E.g. in case of 25 $m^3/h$ material quantity, for 10% moisture content reduction, the diameter of the drying space is 6.5 m, and its height 2 m. The size of the gap between the drying space and base plate 52 is variable according to the properties of the material to be dried, and less for more fluent materials.

The worm conveyors may be replaced for instance with horizontally operating scraper conveyors.

What we claim is:

1. In drying equipment for reducing the moisture content of fragmentary material, comprising upright latticed walls defining between them a drying space in the form of a ring of circular or polygonal base, means for conveying material to be dried to an upper portion of said drying space, and means for removing dried material from a lower portion of said drying space; the improvement comprising conveyor means extending from adjacent the center of said ring radially outwardly of the ring over said drying space for delivering material to be dried from adjacent the center of the ring outwardly to said drying space, and means for rotating said conveying means about the center of the ring thereby to distribute said material in said drying space about said ring.

2. Drying equipment as claimed in claim 1, and means movable with the outer end of said conveying means for leveling material deposited in said drying space by said conveying means.

3. Drying equipment as claimed in claim 2, said leveling means comprising a rotary leveler that rotates about a horizontal axis, and power means for rotating said rotary leveler.

4. Drying equipment as claimed in claim 3, said power means also swinging the outer end of said conveying means about said center of said ring.

5. Drying equipment as claimed in claim 1, and power driven conveyor means extending from adjacent the center of said ring radially outwardly of said ring to beneath said drying space, and power means for operating said conveyor means to move material radially inwardly along said conveyor means and also to swing said conveyor means horizontally about said center of said ring.

6. Drying equipment as claimed in claim 5, the last-named conveyor means comprising a screw conveyor rotatable about a horizontal shaft disposed radially of said ring.

* * * * *